United States Patent [19]

King

[11] Patent Number: 4,572,661

[45] Date of Patent: Feb. 25, 1986

[54] TESTER FOR A COPIER

[75] Inventor: Christopher C. King, Paterson, N.J.

[73] Assignee: Monroe Systems for Business, Inc., Morris Plains, N.J.

[21] Appl. No.: 412,618

[22] Filed: Aug. 30, 1982

[51] Int. Cl.[4] ..... G03G 15/08

[52] U.S. Cl. ..... 355/3 DD; 118/688; 118/694; 355/14 D

[58] Field of Search ..... 355/3 R, 3 DD, 14 D; 118/688, 689, 694

[56] References Cited

U.S. PATENT DOCUMENTS

| | | | |
|---|---|---|---|
| 4,032,227 | 6/1977 | Hubbard et al. | 355/14 D |
| 4,108,545 | 8/1978 | Eckert et al. | 355/14 D |
| 4,155,638 | 5/1979 | Blitzer | 355/14 D X |
| 4,343,548 | 8/1982 | Bares et al. | 355/14 D X |
| 4,419,010 | 12/1983 | Grombone et al. | 355/14 D X |
| 4,423,948 | 1/1984 | Kimura et al. | 355/14 D |

*Primary Examiner*—Fred L. Braun

*Attorney, Agent, or Firm*—Lieberman, Rudolph & Nowak

[57] ABSTRACT

A tester can resolve a sensed signal whose duty cycle is proportional to the amount of a developer disposed in a copier. The tester includes an input device and an indication device. The input device is coupled to the copier for providing a processed signal relating to the extent the sensed signal resides in a predetermined state. The indication device is coupled to the input device and can provide an indication of the magnitude of the processed signal.

8 Claims, 2 Drawing Figures

RE: LIT-TEST

TESTER FOR A COPIER

BACKGROUND OF THE INVENTION

The present invention relates to copiers and in particular to test equipment for determining the amount of developer in a copier.

It is known (for example, the RL-612 copier by Monroe) to employ a photosensitive drum onto which toner is deposited by a developing roller. Magnetically held on this developing roller are metallic carriers impregnated with toner. The toner is electrostatically transferred from the roller to the drum in accordance with the pattern of electrostatic charges on the drum, to produce a preliminary image. In this known copier the density of the toner is measured by a swinging lever attached in the toner bin but spaced from the drum. As the developer travels it urges the lever into electrically conductive brushes. Should the developer have insufficient toner, its weight will decrease and the lever will move accordingly. In this manner, the lever can sense whether it is necessary to add toner to the developer as copies are being produced.

An important consideration is accurately adding sufficient developer to the copier initially. A known technique for adding developer requires estimating the duty cycle of contact by the lever and brushes. A serviceman is required to judge when the duty cycle is about 90%, a 90% duty cycle being deemed to represent the correct volume of developer. While an indicator light can display the state of the lever relative to the brushes, it is often difficult for the serviceman to determine whether the duty cycle is actually 90% and his judgment becomes a matter of opinion which may vary from serviceman to serviceman.

Accordingly, there is a need for a simple, effective and accurate apparatus and method for determining whether a copier has the required amount of developer.

SUMMARY OF THE INVENTION

In accordance with the illustrative embodiment demonstrating features and advantages of the present invention, there is provided a tester for resolving a sensed signal. This sensed signal has a duty cycle proportional to the amount of a developer disposed in a copier. The tester includes input means and indication means. The input means is coupled to the copier for providing a processed signal related to the extent that the sensed signal resides in a predetermined state. The indication means is coupled to the input means for providing an indication of the magnitude of the processed signal.

In a related method of the same invention, the volumetric properties of a developer disposed in a copier are measured. This copier has a developer density sensor for producing a sensed signal. The method includes the step of repetitively sensing the sensed signal during a predetermined interval. Another step is counting, after sensing said sensed signal, the number of times during the predetermined interval the sensed signal is in a predetermined state. Another step is changing the volume of developer in the copier if the count in the predetermined interval is not within a predetermined range.

By employing the foregoing apparatus and method, one can effectively and accurately install developer into a copier. In a preferred embodiment, the randomly occurring brush signal, indicative of the toner density, is processed by a data latch that is normally included in the copier. The data latch is periodically updated and in effect holds or samples the existing data at regular intervals. The preferred tester gates this latched data at the same rate as the updating rate to produce a processed signal whose pulse density is related to the duty cycle of the brushes and therefore the volume of developer.

Preferably, an additional count is obtained beyond the count of the modulated pulses indicating brush duty cycle. The clock that triggers the data latch is also counted to establish a standard time base over which measurements are obtained. Since this data is synchronous, the foregoing measurement may be considered ratiometric. Therefore, slow drift in the clock rate will not affect the accuracy of the measurement.

In this preferred embodiment the adequacy of the developer is determined by measuring the number of gated pulses produced during a predetermined number of clock cycles. If the accumulated count resides within a predetermined range, that fact indicates an acceptable volume of developer.

BRIEF DESCRIPTION OF THE DRAWINGS

The above brief description as well as other objects, features, and advantages of the present invention will be more fully appreciated by reference to the following detailed description of the presently preferred but nonetheless illustrative embodiment in accordance with the present invention when taken in conjunction with the accompanying drawings wherein.

DETAILED DESCRIPTION OF THE PREFERRED EMBODIMENT

Figures 1, 2:
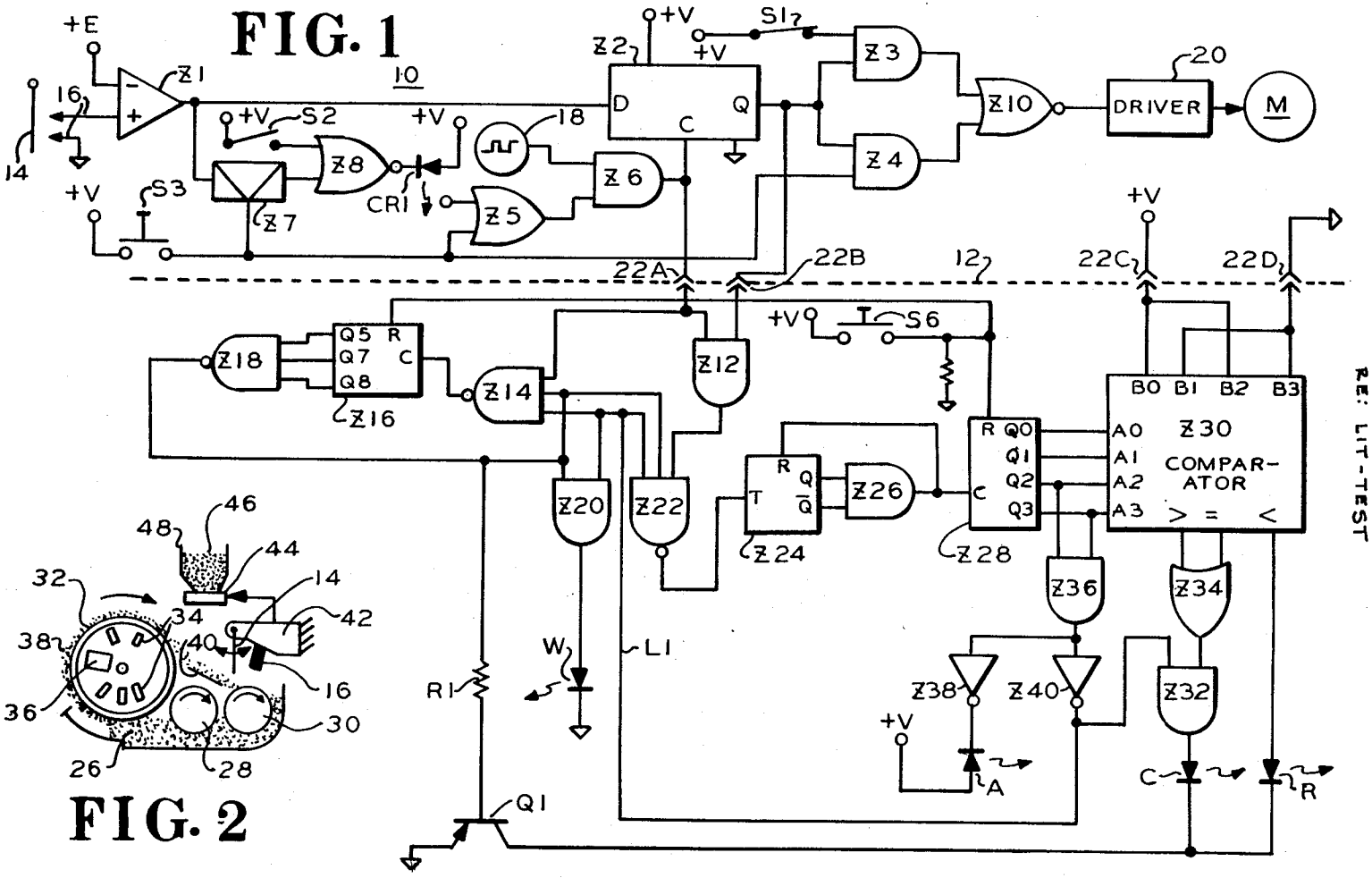
FIG. 1 is a schematic diagram of a tester according to the principles of the present invention.
FIG. 2 is a schematic diagram of a copier having a sensor means for sensing the volume of the developer.

Referring to FIG. 1, a copier is shown having built-in electronics 10 above dotted line 12. The copier electronics 10 includes a sensor means in the form of a lever 14 which may swing against and short electrical brushes 16. One of the contacts of brush 16 is connected to ground, the other being connected to the non-inverting terminal of comparator Z1, whose inverting terminal is connected to reference potential +E. The output of comparator Z1 is connected to data input D of bistable data latch Z2. Output Q of latch Z2 connects to one input of each of the AND gates Z3 and Z4. The other input of AND gate Z3 connects through switch S1 to positive potential +V while the other input of AND gate Z4 connects to one input of OR gate Z5. The output of OR gate Z5 connects to one input of AND gate Z6 whose other input is connected to source 18 of square waves. The output of AND gate Z6 connects to clock input C of latch Z2.

The control input of bilateral switch Z7 is connected to the junction of gates Z4 and Z5 and one terminal of manual switch S3, whose other terminal connect to potential +V. Switch Z7 is such that a high signal on its control input causes a signal on one of its controlled terminals to be transferred to its other terminal. The output of comparator Z1 connects to one controlled terminal of switch Z7, the other controlled terminal connecting to one input of NOR gate Z8. The other input of NOR gate Z8 connects through switch S2 to positive potential +V. Switches S1 and S2 may be considered closed and open, respectively, for the relevant operations to be described presently. The output of NOR gate Z8 is connected to the cathode of light emitting diode CR1 whose anode connects to positive potential +V. The outputs of AND gates Z3 and Z4 are each separately connected to a respective input of NOR gate Z10, whose output connects to driver circuit 20. Driver 20 is arranged to energize and control a toner motor M. Toner motor M can dispense toner into the developer.

The circuitry illustrated below line 12 in FIG. 1 is a tester. This tester may be built into the copier during manufacture or may be a portable testing device. If the tester is portable, it may be connected to circuitry 10 simply by employing a clip means shown herein as contacts 22A, 22B, 22C, and 22D. In a preferred embodiment, these contacts are made simply by an integrated circuit clip which is clipped onto bistable data latch Z2. Since potential +V and ground exists at integrated circuit Z2 as well as the two other signals being monitored, connection for test purposes is easily accomplished.

An input means of the tester, shown herein as AND gate Z12 having one input connected through contacts 22A to clock input C of integrated circuit Z2. The other input of AND gate Z12 is connected through contacts 22B to output Q of circuit Z2. Triple input NAND gate Z14 has one input connected to contacts 22A and the other inputs separately connected to line L1 and L2. The output of NAND gate Z14 is connected to an indication means, shown herein as binary counter Z16, at its clock input C. The inputs of triple input NAND gate Z18 are shown connected to outputs Q5, Q7, and Q8 of counter Z16. Outputs Q5, Q7 and Q8 correspond to the binary digits having a value of 16, 64 and 128, respectively. Accordingly, if a count starts from zero, then NAND gate Z18 will produce a low output when counter Z16 reaches 208. The output of NAND gate Z18 connects to line L2. Lines L1 and L2 also separately connect to different inputs of AND gate Z20 whose output connects to the anode of light emitting diode W, its cathode being grounded.

The output of gate Z12 connects to one input of triple input NAND gate Z22, whose two other inputs separately connect to line L1 and L2. The output of gate Z22 connects to additional parts of the indication means. In particular, the output of NAND gate Z22 connects to toggling input T of a counting means, shown employing first counter Z24. Counter Z24 is a toggle-type counter having outputs Q and $\overline{Q}$ separately connected to different inputs of AND gate Z26, whose output connects to reset input R of counter Z24. Being connected in this fashion, AND gate Z26 produces one pulse for every three pulses supplied to input T of counter Z24.

The output of AND gate Z26 also connects to binary counter Z28 which is also part of the counting means. Counters Z28 and Z24 are referred to as a first counter, counter Z16 being the second. Counter Z28 has its clock input C connected to the output of ANG gate Z26 and its outputs Q0, Q1, Q2 and Q3 (values of 1, 2, 4 and 8 respectively) connected to the inputs A0, A1, A2 and A3, respectively, of digital comparator Z30. The latter inputs (inputs A) are compared to the B inputs, designated herein as B0, B1, B2 and B3, which have assigned values of 1, 2, 4, and 8, respectively. Inputs B0 and B2 are connected through contacts 22C to high potential +V. Inputs B1 and B3 are connected through contacts 22D to ground. Being connected in this fashion, the B input corresponds to a digital value of five. Comparator Z30 has outputs >, = and < which are high when the A inputs are greater than, equal to, and less than, respectively, the B inputs. One terminal of normally open start switch S6 commonly connects to reset inputs R of counters Z16 and Z28, the other terminal being connected to positive potential +V.

Previously mentioned line L2 connects through resistor R1 to the base of PNP transistor Q1 whose emitter is grounded. Its collector connects to the cathodes of light emitting diodes C and R. The anode of light emitting diode R connects to output < of comparator Z30. The anode of diode C connects to the output of AND gate Z32. Gate Z32 has one input connected to the output of OR gate Z34, the other input being connected to line L1. The inputs of OR gate Z34 connect to outputs > and = of comparator Z30. The outputs Q2 and Q3 of counter Z28 separately connect to different inputs of AND gate Z36, whose output is commonly connected to the inputs of inverters Z38 and Z40. The outputs of inverters Z40 and Z38 connect to line L1 and the cathode of light emitting diode A, respectively. The anode of diode A connects to positive potential +V.

Referring to FIG. 2, a schematic illustration is given of a copier system employing developer 26. Developer 26 is a known substance having a metallic, particulate, carrier which can hold on its irregular surface powdered toner. Proper mixing of developer 26 is ensured by rollers 28 and 30 which are adjacent and turn in the same direction. Rollers 28 and 30 tend to urge developer 26 towards a developer roller 32 which turns during a copying cycle, in the direction indicated. Roller 32 has mounted within it five magnets 34 and a sixth larger magnet 36, all six of which are stationary and about which roller 32 rotates. The magnetic fields thus produced cause the metallic carrier and its toner to cling to the surface of developer roller 32. Since magnet 36 is considerably more powerful, it produces adjacent to it a toner brush 38. This brush is used for purposes so well known they need not be specifically described herein.

Developer carried past brush 38 reaches an area where there are no adjacent magnets and therefore falls onto guide plate 40. Depending from support 42 is previously mentioned lever 14. If an insufficient volume of developer descends from roller 32 across plate 40, the developer will not impinge sufficiently against lever 14 to drive it against brush contacts 16. Such lack of contact will open an electrical circuit. Under certain conditions opening of this circuit can energize hopper gate 44 and cause toner 46 in hopper 48 to fall into developer 26, thereby replenishing the toner.

To facilitate an understanding of the principles associated with the present invention, the operation of the apparatus of FIGS. 1 and 2 will now be briefly described. It will be assumed that a serviceman is changing or replenishing developer 26 (FIG. 2) and for this reason has removed hopper 48 and its toner 46. The serviceman will energize rollers 28, 30 and 32, causing developer 26 to travel around roller 32 and down guideplate 40. Therefore lever 14 can sense the amount of developer. In general terms, an excessive volume of developer will cause lever 14 to swing (counter-clockwise in this view) against brushes 16. As shown in FIG. 1 lever 14 upon striking brushes 16 grounds the noninverting input of comparator Z1 to produce a negative-going signal therefrom. This non-synchronous signal will tend to fluctuate randomly. The serviceman can close switch S3 (which in some embodiments may be a dual purpose addtoner switch) to activate bilateral switch Z7 so that the output of comparator Z1 is conveyed through NOR gate Z8 to light emitting diode CR1. Therefore, light emitting diode CR1 provides a visual indication of the duty cycle of brushes 16. However the random flickering of light emitting diode CR1 is difficult to evaluate visually since the flickering does not occur with any regularity.

The closing of switch S3 also ensures that OR gate Z5 produces a high output so that clock 18 produces through AND gate Z6 a clocking signal that drives input C of latch Z2. Output Q of latch Z2 can produce signals through NOR gate Z10 for driving toner motor M. However, since additional toner is not required under the present circumstances the serviceman will remove or otherwise disable toner motor M.

In the past, servicemen have determined the duty cycle of brushes 16 by observing the fluctuations of voltage at motor M. However this does not provide reliable indication since it is not properly correlated to the desired quantities. However, the output data at the contact 22B constitute either a high or low signal that can change only in synchrony with clock 18. Therefore, these synchronous data are readily processed by the tester as described herein.

The serviceman may now depress switch S6 to reset counters Z16 and Z28. Accordingly counter Z28 produces a zero count so that both inputs to gate Z36 are low and light emitting diode A is off. Also since counter Z16 is reset and all inputs to gate Z18 are low, the resulting high output on line L2 reverse biases the base-emitter junction of transistor Q1, turning it off and light emitting diodes C and R off. Since, as previously noted, the output of gate Z36 is low, inverter Z40 produces a high output on line L1. Since line L1 and line L2 are both high at this time, so are both inputs to AND gate Z20 so that it energizes light emitting diode W. Illumination of diode W indicates that the system is counting and the serviceman must wait. With lines L1 and L2 high, two of the inputs to NAND gate Z14 are high so that the clock pulses from gate Z6 applied on the third input are transferred to counter Z16, causing it to count. In a preferred embodiment, the clock pulses from gate Z6 have a frequency of 1.2 HZ.

Also, the high lines L1 and L2, being connected to two of the inputs of NAND gate Z22 ensure that the data output of gate Z12 is applied to the toggle input T of counter Z24. The output of AND gate Z12 is the same output produced at output Q of latch Z2 but periodically held at zero by the clock signal (clock 18). Thus the output of gate Z12 will remain low for a full clock cycle whenever the output of data latch Z2 is low. However, when the data latch Z2 produces a high output, the output of gate Z12 will only be high for one half of a clock cycle. Thus the output from gate Z12 produces one pulse for each clock cycle during which the latch Z2 is in a high state. Otherwise, it produces no pulses. Counter Z24 and gate Z26 are connected to divide by 3 and thus provide a scaling function so that the number of pulses counted by subsequent stages do not become excessive. The next counting stage, counter Z28, has a capacity of 16 but is terminated earlier, as will be described presently.

It will be assumed for now that brush contacts 16 are closed infrequently, indicating insufficient developer. Consequently, the output Q of latch Z2 will be mostly high so that gate Z12 produces a pulse during almost every clock cycle. When 36 such pulses have been transmitted from gate Z12, counter Z28 reaches a count of 12 wherein its outputs Q2 and Q3 both become high. Consequently AND gate Z36 can produce through inverter Z40 a low output which is coupled to respective inputs of each of the gates Z14, Z20 and Z22. Since gates Z14 and Z22 are thus disabled, counting stops in counters Z16, Z24 and Z38. Also since the low input on line L1 is applied to an input of AND gate Z20 its resulting low output turns off the "wait" light emitting diode W. The high output of gate Z36 energizes light emitting diode A through inverter Z38. The illumination of diode A indicates to the serviceman that the amount of the developer is insufficient and more must be added.

It will now be assumed that the serviceman adds an excessive amount of developer so that lever 14 engages brush contacts 16 too frequently. Consequently, comparator Z1 produces a low signal too often. As a result latch Z2 produces on its output Q a low output for too long. As a result, AND gate Z12 produces very few pulses. When the serviceman next depresses switch S6, he resets counters Z16 and Z28 allowing counting in the manner just described. However, since very few pulses reach counter Z28, it does not reach a count of 12 so that AND gate Z36 never produces a high signal, as previously described. Instead, counter Z16 continues to count until it reaches a count of 208 after 172 seconds have elapsed. At that time all of its three outputs Q5, Q7, and Q8 will be high causing a low signal on line L2. The low level on L2 not only turns off wait light W as previously described, but also forward biases the base-emitter junction of transistor Q1, turning it on. Also when line L2 goes low it forces NAND gate Z14 and Z22 to maintain a high output signal, thereby terminating counting in counters Z16, Z24 and Z28. Since very few pulses reach counter Z28 it has a low count, presumed to be less than five. Accordingly, neither outputs > or = are high. Therefore OR gate Z34 applies a low output to the input of AND gate Z32 ensuring that light emitting diode C is off. However, the high output < from comparator Z30 causes current to flow through light emitting diode R through conducting transistor Q1. Illumination of diode R alerts the serviceman to remove developer from the copier.

It will now be assumed that the serviceman removes the proper amount of developer from the copier and again depresses switch S6 to commence a sequence of operations similar to that just described. However, in this instance brushes 16 are closed at an appropriate duty cycle so that the number of pulses produced from output Q of latch Z2 is proper. Consequently, when counter Z16 reaches a count of 208, in a manner just described, counter Z28 will have reached a count between 5 to 11, inclusive. Therefore either output > or = of comparator Z30 will be high. Consequently, the output of NOR gate Z34 applies a high signal to one input of AND gate Z32 whose other output receives a high signal from inverter Z40 driven by the low output of gate Z36. The output of gate Z36 is low since counter Z28 presumably, does not reach a count of 12. The high output from gate Z32 drives current through light emitting diode C through conducting transistor Q1. Illumination of light emitting diode C alerts the serviceman that the amount of developer in the copier is correct.

It is to be appreciated that various modifications may be implemented with respect to the above described preferred embodiment. For example, while various digital components are disclosed, in some instances analog circuits may be substituted therefore. Also various lamps may be used instead of the described lighting emitting diodes. Furthermore, the amount of counting can be rescaled by changing the clock period, the time base and/or the limits of the comparator. Also, while a comparator is shown, simple combinational logic may be used in some cases to detect whether the final count falls within a desired range. Also while four lamps are illustrated, it will be understood that in other embodiments a different number may be employed. Additonally, the frequency of the clock or the count of the time base counter can be modified depending upon the desired speed of conversion. Moreover, a data latch may not be found in the copier or may not be used, in which case another data latch operating at a higher speed may be employed in the test apparatus. However, it is desired that the conversion take place over a relatively long interval so that the data is averaged and is reliable. Additionally, the various components may be altered depending upon the desired speed, power handling capacity, temperature stability, frequency of response, count capacity, etc.

Obviously, many modifications and variations of the present invention are possible in light of the above teachings. It is therefore to be understood that within the scope of the appended claims, the invention may be practiced otherwise than as specifically described.

What is claimed is:

1. A tester for determining the proper amount of developer to be placed in a copier storage reservoir in response to a sensed signal whose duty cycle is proportional to the amount of developer disposed in said copier storage reservoir, comprising:

input means coupled to said copier for providing a processed signal in response to said sensed signal residing in a predetermined state, said processed signal indicative of the amount of developer to be placed in a copier storage reservoir during an initial start-up operation;

means responsive to the frequency of said processed signal for determining the manner in which the amount of developer in the copier storage reservoir should be adjusted to attain a correct amount of developer, and indication means coupled to said determining means for providing an indication that the proper amount of developer has been placed in the copier storage reservoir, wherein said indication and determining means comprises counting means for repetitively sensing said sensed signal and for counting during a predetermined interval the number of times said sensed signal is in said predetermined state, said indication and determining means being operable to provide an indication of the count of said counting means.

2. A tester according to claim 1 wherein said input means comprises:

gate means for periodically interrupting said sensed signal, said predetermined interval bearing a predetermined ratio to the period of said gate means.

3. A tester according to claim 2 wherein said counting means comprises:

a first counter driven by said processed signal, said indication and determining means further comprising:

a second counter for counting the number of times said gate means interrupts said sensed signal, said second counter being operable upon reaching a predetermined scale number to interrupt the counting of said first counter.

4. A tester according to claim 3 wherein said first counter is operable upon reaching a predetermined limit number to interrupt the counting of said second counter.

5. A tester according to claim 1 wherein said indication and determining means are operable to provide a visual indication of whether the count of said counting means lies within a predetermined range after said predetermined interval.

6. A tester according to claim 1 wherein said counting means is operable to provide a visual indication whether its count is above or below a predetermined range after said predetermined interval.

7. A tester according to claim 1 wherein said copier has a bistable data latch that is periodically clocked to produce and vary said sensed signal, said input means including:

clip means for connecting to said latch to monitor its clocking and its sensed signal.

8. A copier having toner-carrying developer and means for monitoring the developer, comprising:

sensor means for producing a sensed signal signifying the volumetric properties of the developer;

input means for providing a processed signal in response to said sensed signal, said processed signal indicative of the amount of developer to be placed in a copier storage reservoir during an initial start-up operation;

means responsive to the frequency of said processed signal for determining the manner in which the amount of developer in the copier storage reservoir should be adjusted to attain a correct amount of developer; and indication means coupled to said determining means for providing an indication that the proper amount of developer has been placed in the copier storage reservoir, wherein said indication means comprises counting means for repetitively sensing said sensed signal and counting during a predetermined interval the number of times said sensed signal is in said predetermined state, said indication means being operable to provide an indication of the count of said counting means.

* * * * *